US006739220B1

(12) United States Patent
Johnson et al.

(10) Patent No.: US 6,739,220 B1
(45) Date of Patent: May 25, 2004

(54) MOTORIZED LIGHT BULB CHANGER

(75) Inventors: Ronald L. Johnson, San Jose, CA (US); Norio Sugano, Portola Valley, CA (US)

(73) Assignee: Wagic, Inc., San Jose, CA (US)

( * ) Notice: Subject to any disclaimer, the term of this patent is extended or adjusted under 35 U.S.C. 154(b) by 0 days.

(21) Appl. No.: 10/218,404

(22) Filed: Aug. 12, 2002

(51) Int. Cl.[7] ..... H01K 3/32
(52) U.S. Cl. ..... 81/53.12; 81/53.1
(58) Field of Search ..... 81/53.1, 53.11, 81/53.12; 294/64.1

(56) References Cited

U.S. PATENT DOCUMENTS

| | | | | |
|---|---|---|---|---|
| 548,537 | A | 10/1895 | Green | |
| 558,573 | A | 4/1896 | Smith | |
| 578,394 | A | 3/1897 | Dunn et al. | |
| 609,421 | A | 8/1898 | Edwards | |
| 623,180 | A | 4/1899 | Rhine | |
| 634,419 | A | 10/1899 | Welden | |
| 636,229 | A | 10/1899 | Simms | |
| 659,631 | A | 10/1900 | Croteau et al. | |
| 673,191 | A | 4/1901 | Arthur | |
| 675,640 | A | 6/1901 | Renard | |
| 750,408 | A | 1/1904 | Speelman | |
| 801,902 | A | 10/1905 | Olafson | |
| 809,985 | A | 1/1906 | Rundberg | |
| 869,836 | A | 10/1907 | Gaynor | |
| 895,625 | A | 8/1908 | Gaynor | |
| 925,084 | A | 6/1909 | Edgerton | |
| 927,908 | A | 7/1909 | Webb | |
| 977,158 | A | 11/1910 | Berkstresser | |
| 987,562 | A | 3/1911 | Ferguson | |
| 1,056,084 | A | 3/1913 | Bates | |
| 1,133,613 | A | 3/1915 | Buss et al. | |
| 1,193,685 | A | 8/1916 | Harvey | |
| 1,201,506 | A | 10/1916 | Rozelle et al. | |
| 1,202,432 | A | 10/1916 | Rozelle et al. | |
| 1,210,835 | A | 1/1917 | Price | |
| 1,223,791 | A | 4/1917 | Jackson | |
| 1,258,430 | A | 3/1918 | Morris | |
| 1,311,776 | A | 7/1919 | Rodriguez | |
| 1,449,358 | A | 3/1923 | Weber | |
| 1,514,814 | A | 11/1924 | Allen | |
| 1,540,143 | A | 6/1925 | Pierpoint | |
| 1,541,839 | A | 6/1925 | Metzler et al. | |
| 1,787,670 | A | 1/1931 | Clarkson | |
| 1,823,170 | A | 9/1931 | Schulz | |
| 1,847,953 | A | 3/1932 | Finesey | |
| 2,357,104 | A | 8/1944 | Grinnell | 294/20 |
| 2,387,846 | A | 10/1945 | Hays | 294/20 |
| 2,573,002 | A | 10/1951 | Foster | 294/21 |
| 2,616,743 | A | 11/1952 | Negley | 294/21 |
| 2,669,478 | A | 2/1954 | Bowie | 294/20 |
| 2,946,615 | A | 7/1960 | Yawman, Jr. et al. | 294/20 |
| 2,983,541 | A | 5/1961 | Maki | 294/20 |
| 3,549,188 | A | 12/1970 | Cerasoli | 294/21 |
| 3,666,311 | A | 5/1972 | McMullin | 294/19 R |

(List continued on next page.)

*Primary Examiner*—Joseph J. Hail, III
*Assistant Examiner*—David B. Thomas
(74) *Attorney, Agent, or Firm*—Haverstock & Owens LLP

(57) ABSTRACT

A light bulb changing tool comprising a motorized clasping mechanism configured to engage a light bulb, the motorized clasping mechanism configured along an axis, the motorized clasping mechanism configured to actuate in a first direction and a second direction; and a electronic drive unit configured to remotely communicate with the motorized clasping mechanism, wherein the electronic drive unit sends control signals to drive the motorized clasping mechanism to selectively move in the first direction and the direction. The tool further comprising an arm member for positioning the motorized clasping mechanism in a desired configuration to engage the light bulb, wherein the arm member is coupled to the motorized clasping mechanism. The motorized clasping mechanism further comprises a rotator mechanism configured to rotate the motorized clasping mechanism in the first direction about the axis.

26 Claims, 7 Drawing Sheets

U.S. PATENT DOCUMENTS

| | | | | |
|---|---|---|---|---|
| 3,696,694 | A | 10/1972 | Boro | 81/57.27 |
| 3,731,966 | A | 5/1973 | Nagy | 294/20 |
| 3,776,584 | A | 12/1973 | Van Gerven | 294/21 |
| 3,788,691 | A | 1/1974 | McMullin | 294/19 R |
| 3,799,599 | A | 3/1974 | Jordan | 294/20 |
| 4,167,354 | A | 9/1979 | Walker | 403/291 |
| 4,218,085 | A | 8/1980 | Unger | 294/20 |
| 4,385,849 | A | 5/1983 | Crain | 403/109 |
| 4,611,512 | A | 9/1986 | Honda | 81/53.1 |
| 4,663,996 | A | 5/1987 | Grudgfield et al. | 81/53.11 |
| 4,719,826 | A | 1/1988 | DuBois | 81/53.12 |
| 4,730,960 | A | 3/1988 | Lewis et al. | 408/127 |
| D297,499 | S | 9/1988 | Whitney | D8/14 |
| 4,791,835 | A | 12/1988 | Unger et al. | 81/53.12 |
| 4,844,171 | A | 7/1989 | Russell, Jr. | 166/377 |
| 4,852,925 | A | 8/1989 | Lodin | 294/2 |
| 4,864,899 | A | 9/1989 | Morse | 81/53.11 |
| 4,876,929 | A | 10/1989 | Kozak | 81/57.43 |
| 4,901,606 | A | 2/1990 | Christensen | 81/57.11 |
| 4,970,921 | A | 11/1990 | Fagan | 81/121.1 |
| 5,103,695 | A | 4/1992 | Dolle et al. | 81/53.11 |
| 5,123,311 | A | 6/1992 | Dymek | 81/177.6 |
| 5,148,723 | A | 9/1992 | Newman, Sr. et al. | 81/53.11 |
| 5,218,889 | A | 6/1993 | Brockberg | 81/53.11 |
| 5,317,939 | A | 6/1994 | Marinescu | 81/53.11 |
| 5,330,243 | A | 7/1994 | Held | 294/19.1 |
| 5,379,666 | A | 1/1995 | Held | 81/53.1 |
| 5,385,420 | A | 1/1995 | Newman, Sr. et al. | 403/299 |
| 5,386,744 | A | 2/1995 | Garcia | 81/53.11 |
| 5,436,526 | A | 7/1995 | Hohaus et al. | 313/51 |
| 5,458,026 | A | 10/1995 | Southard et al. | 81/53.1 |
| 5,464,407 | A | 11/1995 | McGuire | 606/86 |
| 5,490,438 | A | 2/1996 | Zupo et al. | 81/53.11 |
| 5,546,291 | A | 8/1996 | Simes | 362/223 |
| 5,553,373 | A | 9/1996 | Sprayberry | 29/758 |
| 5,564,852 | A | 10/1996 | Maxwell et al. | 403/97 |
| 5,572,913 | A | 11/1996 | Nasiell | 81/177.6 |
| 5,593,196 | A | 1/1997 | Baum et al. | 294/19.1 |
| 5,647,622 | A | 7/1997 | Schectman | 294/19.1 |
| 5,649,255 | A | 7/1997 | Schieltz | 396/427 |
| 5,692,417 | A | * 12/1997 | Irpino | 81/53.12 |
| 5,697,269 | A | 12/1997 | Tseng | 81/177.6 |
| 5,730,033 | A | 3/1998 | Mitrowski | 81/53.11 |
| 5,752,287 | A | 5/1998 | Wheat | 15/176.2 |
| 5,765,453 | A | 6/1998 | Mims | 81/53.11 |
| 5,797,918 | A | 8/1998 | McGuire et al. | 606/104 |
| 5,802,692 | A | 9/1998 | Philippe | 29/263 |
| 5,806,903 | A | 9/1998 | George | 294/19.1 |
| 5,809,850 | A | 9/1998 | Tickner | 81/53.11 |
| 5,823,073 | A | 10/1998 | Tickner | 81/53.11 |
| 5,941,139 | A | 8/1999 | Vodehnal | 81/57.43 |
| 6,453,777 | B1 | 9/2002 | Newman et al. | 81/53.11 |

* cited by examiner

MOTORIZED LIGHT BULB CHANGER

FIELD OF THE INVENTION

The present invention relates to a remote access tool. More specifically, the present invention relates to a motorized device designed to remove and replace light bulbs which are held at a variety of angles and heights and are otherwise inaccessible from ground level.

BACKGROUND OF THE INVENTION

Numerous light bulb removal tools have been patented which alleviate the problems associated with replacing light bulbs from remote locations. One such problem is accessibility. Overhead lights are purposefully positioned out of reach to minimize risks associated with heat burns and unintentional contact which could result in-globe glass breakage. Another problem stems from the variety of angles from which bulbs must be extracted and replaced from these remote locations, such as from chandeliers and hanging light arrangements. Another problem is the adjustability of the handle to reach light bulbs at varying distances.

U.S. Pat. No. 1,514,814 to Allen, discloses an electric bulb holder which has bulb gripping arms that are pivotally connected to a slidable member which causes the bulb gripping arms to spread around the light bulb and then collapse to grip the light bulb. Once the user has a grip of the light bulb, she must rotate the whole bulb holder to screw or unscrew the light bulb. Further, the handle in this patent does not have a flexible arm for reaching light bulbs that are at an angle.

U.S. Pat. No. 2,983,541 to Maki discloses a device for removing or placing light bulbs in sockets. Specifically, the device taught by Maki consists of a fixed rod with a bendable arm for reaching light bulbs at different angles. The patent discloses using a helicoidal operating member inside the bendable arm which is bendable and rotatable. However, the device taught by Maki, by having a fixed rod, does not allow the user to adjust the rod to different heights. Also, the user must use an air bulb to create suction in an engaging cup to engage the light bulb. This is disadvantageous to the user, because the cup is not adjustable to engage different sized light bulbs.

U.S. Pat. No. 2,616,743 to Negley discloses a light bulb changer having a rigid handle and a bendable arm attached to the handle. Although this light bulb changer allows the user to bend the arm to engage light bulbs at different angles, the light bulb changer does not allow the user to adjust the handle to different heights. Further, the light bulb changer taught by Negley does not allow the user to adjust the mechanism to fit differently sized light bulbs.

U.S. Pat. Nos. 1,202,432 and 1,201,506 to Rozelle et al., both disclose an adjustable device for placing and removing electric light bulbs. Specifically, the device taught in these patents utilizes a rod which has a pivoting section about a clamp screw for reaching light bulbs at different angles. However, the pivoting section is locked by tightening the clamp screw, which is burdensome on the user, because the user must use a screw driver, or some other external tool, to lock the pivoting shaft. Further, the rods taught in this patent are also adjustable to reach light bulbs at different heights, but the mechanism to lock the rods at a desired height is limiting. The mechanism to prevent the sliding of the rods consists of pins positioned along the rod which are configured to slide into a bayonet slot cut into the outer surface of the rod. Therefore, the user can only adjust the rod at certain heights, which is burdensome if the light bulb is at a height that does not correspond to any of the positions available on the rod.

SUMMARY OF THE INVENTION

In one aspect of the present invention is a tool for selectively tightening and loosening a light bulb. The tool comprises means for clasping the light bulb. The clasping means is configured to have an adjustable dimension that is for clasping a correspondingly sized light bulb. The tool includes means for activating the clasping means. The activating means is configured for remote communication with the clasping means, wherein the activating means sends control communications to move the clasping means in a first direction and a second direction. The tool further comprises means for setting the clasping means in a desired configuration to engage the light bulb. The setting means is coupled to the clasping means. The setting means further comprises a means for varying the adjustable dimension. The varying means is coupled to the activating means. The control communications are preferably sent wirelessly from the activating means to the clasping means. In an alternative embodiment, the clasping means and the activating means are coupled to one another by a cable. The clasping means and the activating means are preferably coupled to a tubular member. The tool further comprises means for securing the wire to the tubular member, wherein the overall length of the tubular member is able to be selectively adjusted. The means for activating is preferably powered by a DC voltage source and alternately by an AC voltage source.

In another aspect of the invention is a light bulb changing tool that comprises a motorized clasping mechanism that is configured to engage a light bulb. The motorized clasping mechanism is configured along an axis and to actuate in a first direction and a second direction. The tool includes an electronic drive unit that is configured for remote communication with the motorized clasping mechanism. The electronic drive unit sends control communications to drive the motorized clasping mechanism to selectively move in the first direction and the second direction. The tool further comprises an arm member that positions the motorized clasping mechanism in a desired configuration to engage the light bulb. The arm member is coupled to the motorized clasping mechanism. The motorized clasping mechanism further comprises a rotator mechanism that is configured to rotate the motorized clasping mechanism in the first direction about the axis. The motorized clasping mechanism further comprises a plurality of spring urged fingers. The tool further comprises an adjusting mechanism that is configured to actuate the motorized clasping mechanism in the second direction. The control communications are sent wirelessly from the electronic drive unit to the motorized clasping mechanism. The motorized clasping mechanism and the electronic drive unit are alternatively coupled to one another by a cable. The motorized clasping mechanism and the electronic drive unit are preferably coupled to a tubular member. The tool further comprises a clip that secures the cable to the tubular member. The electronic drive unit is preferably powered by a DC voltage source and alternatively by an AC voltage source.

In yet another aspect of the invention is a method of assembling a light bulb changing tool. The method comprises the step of providing a clasping mechanism that is configured to engage a light bulb, wherein the clasping mechanism has an adjustable dimension. The method comprises providing a drive unit in remote communication with the clasping mechanism, wherein the drive unit sends control communications to electrically activate the clasping mechanism to actuate the clasping mechanism in a first direction and a second direction. The method further comprises the step of coupling an adjusting arm to the clasping mechanism, whereby the adjusting arm is configured to adjust the clasping mechanism to a desired position that is relative to the light bulb. The method further comprises the step of coupling the clasping mechanism and the drive unit to a tubular member. The control communications are preferably sent wirelessly from the drive unit to the clasping mechanism. The method further comprises the step of coupling the clasping mechanism and the drive unit to one another by a cable. The method further comprises securing the cable to the tubular member with a clip.

DETAILED DESCRIPTION OF THE PREFERRED EMBODIMENTS

Figure 1A:
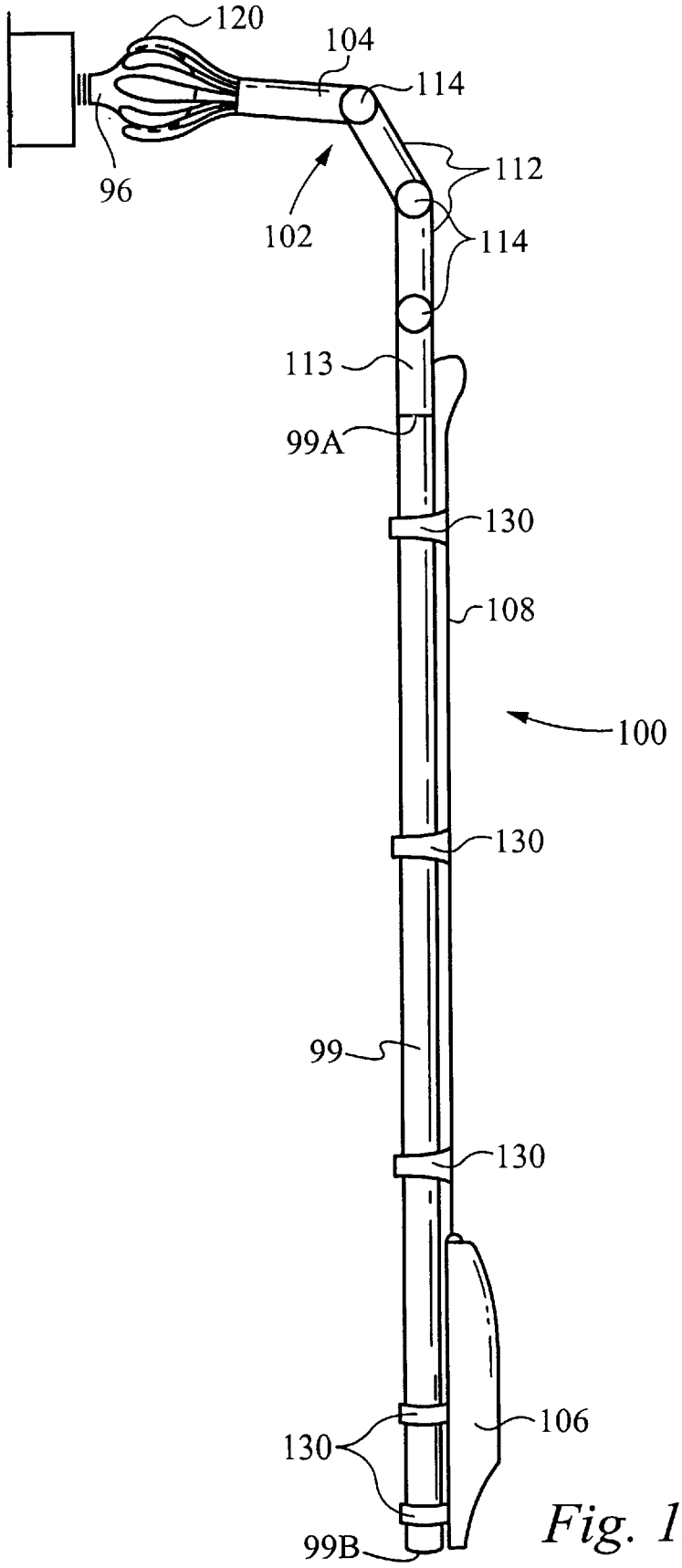
FIG. 1A illustrates a side view of an alternative embodiment of the motorized light bulb changer device with pole in accordance with the present invention.

FIG. 1A illustrates a side view of an alternative embodiment of the motorized light bulb changer device with pole in accordance with the present invention. Generally, the motorized light bulb changer 100 includes a clasping mechanism 102 having a set of fingers 120, a motor unit 104, an arm unit 112 having a pair of arm members 112A and 112B (FIG. 2) and a connecting arm 113. In addition, the light bulb changer 100 includes a drive or power unit 106, whereby the drive unit 106 is coupled to the clasping mechanism 102 by a cable 108. As will be described in detail below, in the preferred embodiment of the present invention, the drive unit 106 communicates wirelessly to control the self-powered clasping mechanism 102. The motorized light bulb changer 100 shown in FIG. 1A is coupled to a pole 99 which allows the user to change light bulbs 96 held at a variety of angles and heights, that are otherwise inaccessible from ground level. It is preferred that the length of the pole 99 be adjustable, although it is not required. The details of an adjustable pole 99 are described in co-pending U.S. patent application, Ser. No. 10/218,474, filed Aug. 12, 2002 entitled, "LIGHT BULB CHANGER" which is hereby incorporated by reference. Any other adjustable pole 99 known in the art is alternatively used in conjunction with the present invention.

Figure 2:
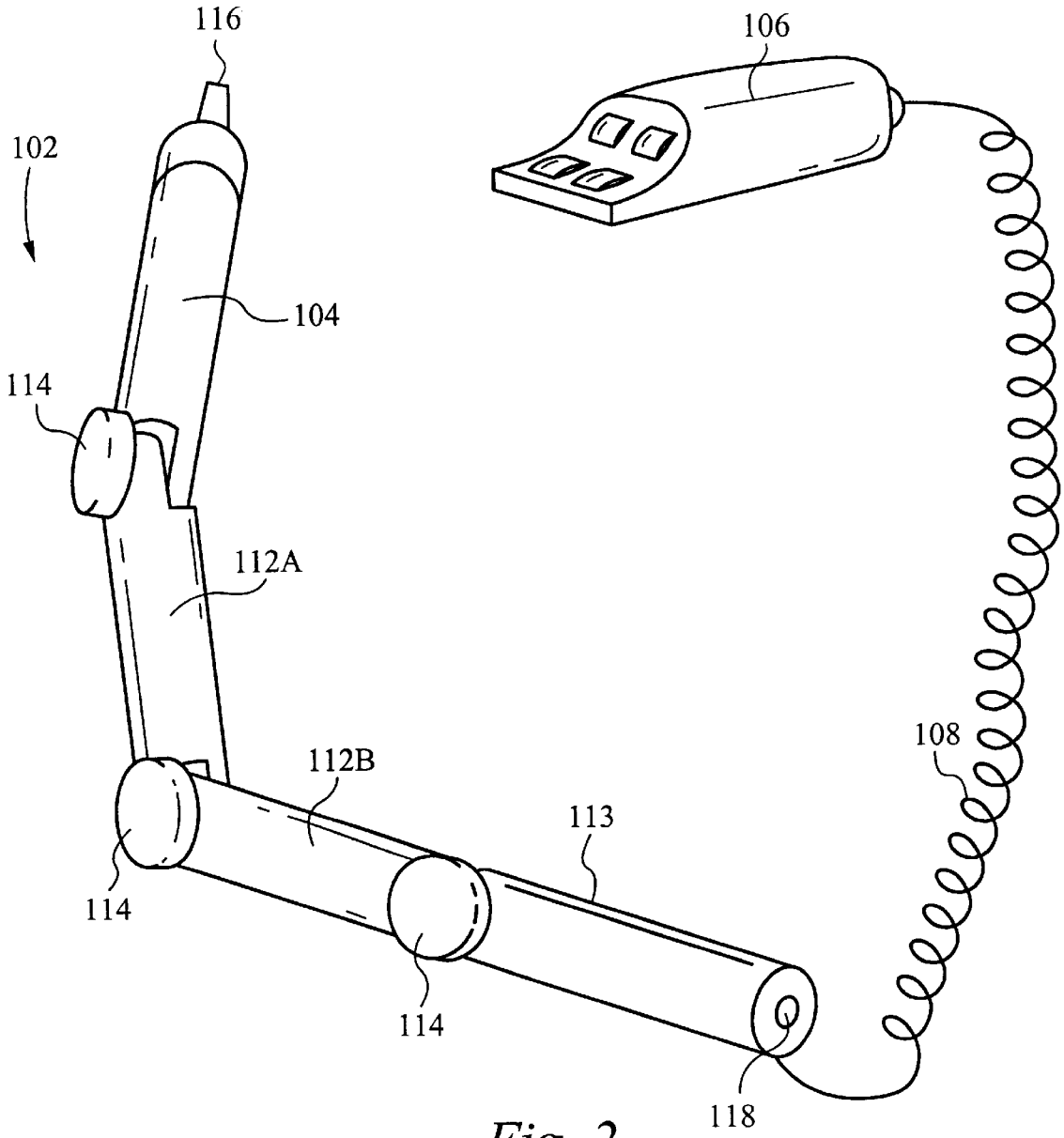
FIG. 2 illustrates a perspective view of the alternative embodiment of the individual components of the motorized light bulb changer in accordance with the present invention.

FIG. 2 illustrates a perspective view of the alternative embodiment of the individual components of the motorized light bulb changer 100 in accordance with the present invention. FIG. 2 shows the clasping mechanism 102 having the motor unit 104, adapter 116, two arm members 112A and 112B, a connecting arm 113, cable 108 and the drive unit 106. As shown in FIG. 2, a motor unit 104 is coupled to two adjustable arm members or components 112A and 112B. Alternatively, any number of adjustable arm components 112 are coupled to the motor unit 104. The adjustable arm components 112 allow the user to set the clasping mechanism 102 to a desired configuration by being rotatable and moveable with respect to one another.

The motor unit 104 is coupled to the upper arm member 112A. The upper arm member 112A is coupled to the lower arm member 112B. The lower arm member 112B is coupled to the connecting arm 113. Preferably, the motor unit 104, the arm members 112A and 112B and the connecting arm 113 are adjustable at any angle with respect to one another by a set of push and lock knobs 114. Alternatively, the motor unit 104, the arm members 112A and 112B and the connecting arm 113 are adjustable at any angle with respect to one another by a set of pull and lock knobs. Preferably, the upper arm 112A and the lower arm 112B are adjustable with respect to one another when the knobs 114 are pushed or released. In contrast, the motor unit 104 as well as the upper arm 112A and the lower arm 112B are not adjustable when the are in the locked position. Accordingly, the user is able to position the arms 112A and 112B in the desired configuration while the knobs 114 are released and then tighten the knobs 114 to maintain the arms 112A and 112B in that configuration by setting the knobs to the locked position. Alternatively, any other means for tightening and loosening the drive unit 110 as well as the upper arm 112A, the lower arm 112B and connecting arm 113 with respect to one another are used, including but not limited to rotatable loosening and tightening knobs, pins, screws and bolts. The connecting arm 113 shown in FIG. 2 includes an aperture 118 which serves to accept an end 99A of the pole 99. Thus, the clasping mechanism 102 engages the end 99A of the pole 99 which is used to reach the light bulb 96.

Figure 1B:
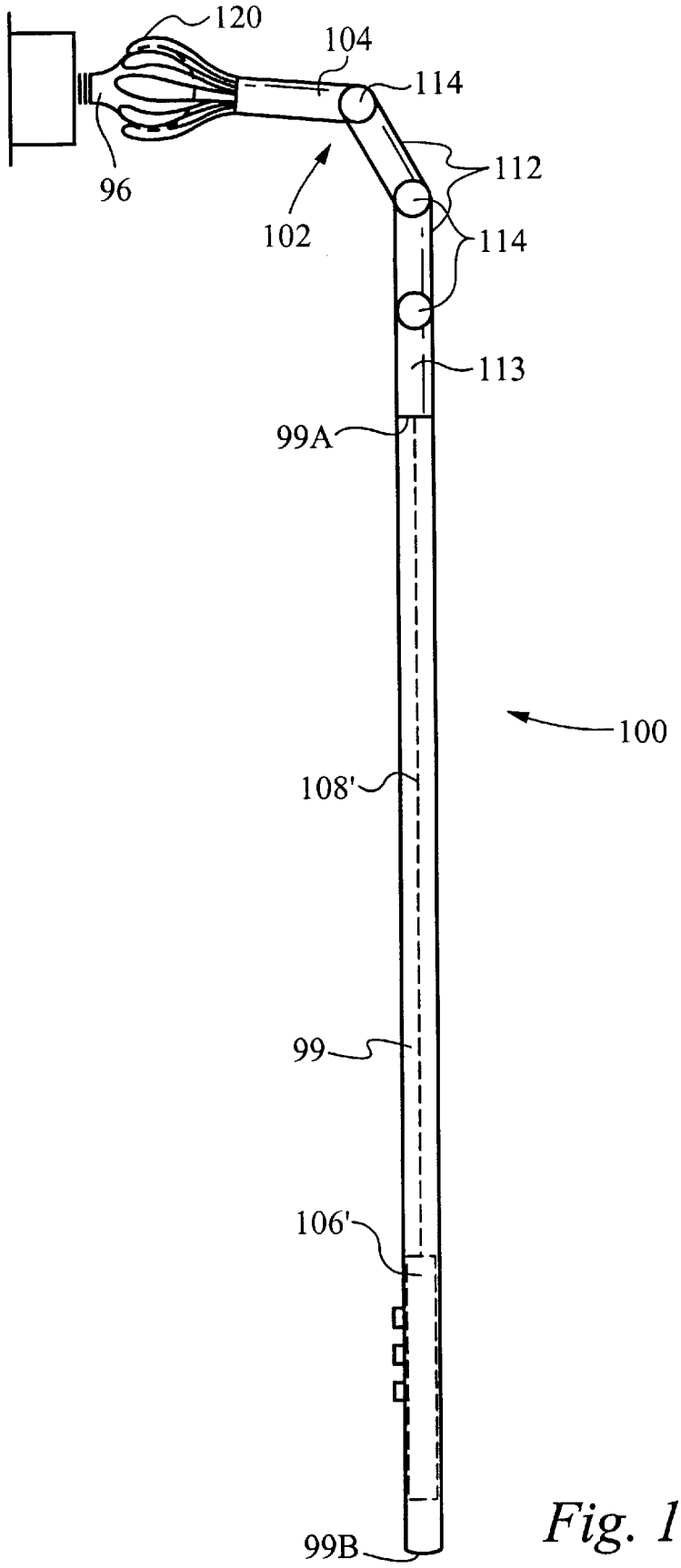
FIG. 1B illustrates a side view of an alternative embodiment of the motorized light bulb changer device with pole in accordance with the present invention.

Shown in FIG. 2 is a drive unit 106 coupled to the motor unit 104. The drive unit 106 is coupled at or near the end 99B of the pole 99, which is opposite the end 99A to which the clasping mechanism 102 is preferably coupled. As shown in FIG. 1A, it is preferred that the drive unit 106 is coupled to the pole 99 by a set of clips 130, which are discussed below. Alternatively, as shown in FIG. 1B, the drive unit 106' as well as the wire 108' connecting the drive unit 108' to the motor unit 104 is configured to be integrated within the pole 99. The drive unit 106 includes a plurality of buttons which allow the user to drive the clasping means 102. As will be discussed in more detail below, the clasping means 102 rotates about axis 97 (FIG. 3A) and is configured for use with attachments having different dimensions between the oppositely faced fingers 120 (FIG. 3A) to adjust to engage light bulbs 96 of different sizes. The movements as well as the direction of movements of the clasping mechanism 102 are controlled by the drive unit 106. Thus, the drive unit 106 supplies a predetermined voltage and/or current to the motor 98 in the motor unit 104 to cause the clasping mechanism 102 to perform the desired movements. Thus, a circuit (not shown) within the drive unit 106 supplies a predetermined voltage to the motor 98, thereby activating or driving the clasping mechanism 102 to move in a clockwise direction. Similarly, the circuit (not shown) within the drive unit 106 supplies another predetermined voltage to the motor 98, thereby driving the clasping mechanism 102 to move in a counter-clockwise direction. The drive unit 106 is powered by a DC voltage, such as batteries. Alternatively, the drive unit 106 is powered by an AC voltage, such as plugging into a wall socket. The drive circuit 106 also provides power to enable the operation of the motor 98 through the cable 108. As will be discussed in detail below, in the preferred embodiment of the present invention, the power source for the motor 98 is resident within the connecting arm 113.

Shown in FIG. 2 is a cable 108 present between the lower arm member 112B and the drive unit 106. The cable 108, although shown in FIG. 2 going into the lower arm member 112B, couples to the motor 98 (FIG. 3A) within the motor unit 104. Although it is shown that the cable 108 couples the drive unit 106 with the motor unit 104, other communication means are used, including but not limited to infra-red, radio frequency and optics. As will be described in detail below, in the preferred embodiment of the present invention, the drive unit 106 preferably communicates with the motor unit 104 using infrared. The cable 108 is secured to the pole 99 by a clip 130 (FIG. 1A). Since a sufficient amount of cable 108 is needed between the motor unit 104 and the drive unit 106 along the length of the pole 99, the number of clips 130 varies depending on the length of the wire 108 and the length of the pole 99. The clip 130 itself is a hook and loop clip or otherwise known as Velcro®, however any type of clip 130 is alternatively used.

Figure 3A:
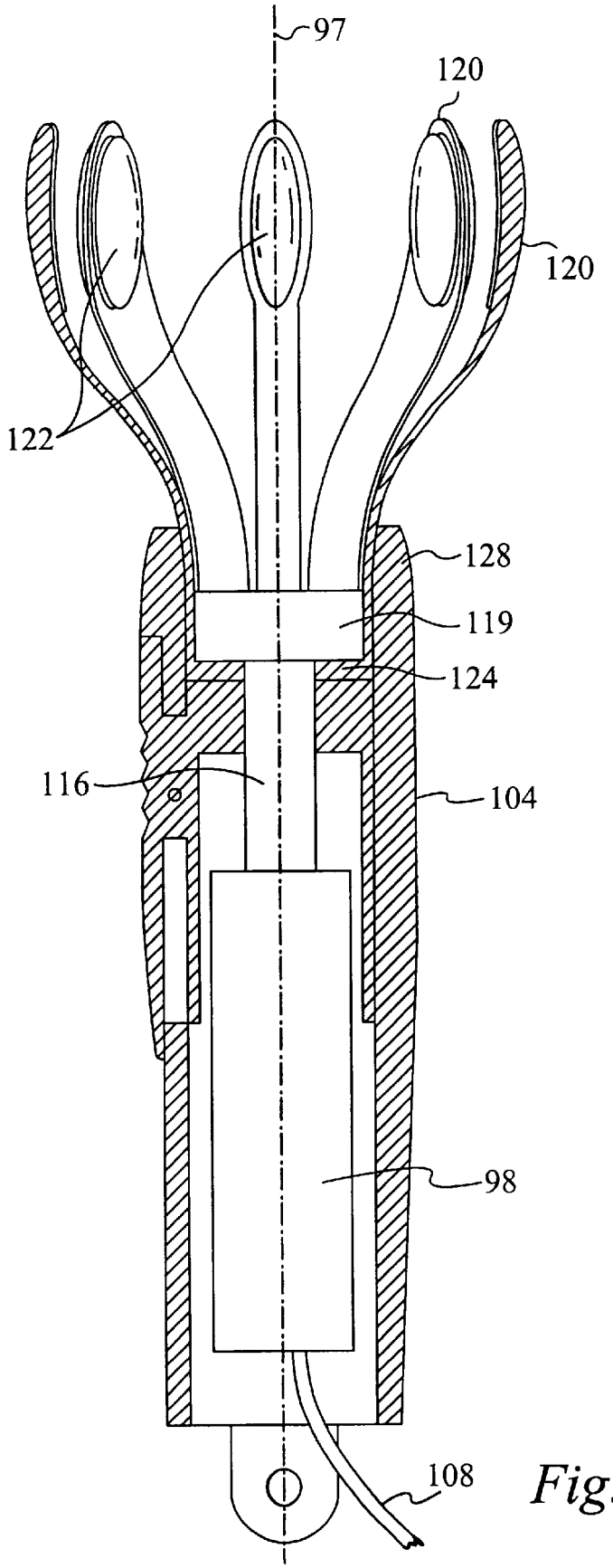
FIG. 3A illustrates a cross sectional view of the alternative embodiment of the clasping mechanism in accordance with the present invention.

FIG. 3A illustrates a cross sectional view of the clasping mechanism 102 in accordance with the present invention. The clasping mechanism 102 includes the motor unit 104 as well as an attachment 119 including a set of fingers 120 coupled to the motor unit 104. The motor unit 104 includes a step-motor 98 within its housing 128, wherein the motor 98 is coupled to the drive unit 106 by the cable 108. Alternatively, the motor 98 is any other appropriate type of motor known in the art, including but not limited to solenoid or direct voltage. The clasping mechanism 102 includes the adapter 116 which is configured to securely receive and hold the clasping attachment 119. Different sized attachments 119 are used to change different sizes of light bulbs.

In an alternative embodiment, the motor 98 controls the adapter 116 which extends out of the top of the motor 98 along the axis 97. In this alternative embodiment, the adapter 116 moves upward and downward as controlled by the motor unit 98 along the axis 97 depending on a predetermined voltage supplied to the motor 98, to either spread or tighten the fingers 120. In addition, the adapter 116 rotates in the clockwise and counterclockwise direction about the axis 97 depending on a predetermined voltage supplied to the motor 98.

Figure 4:
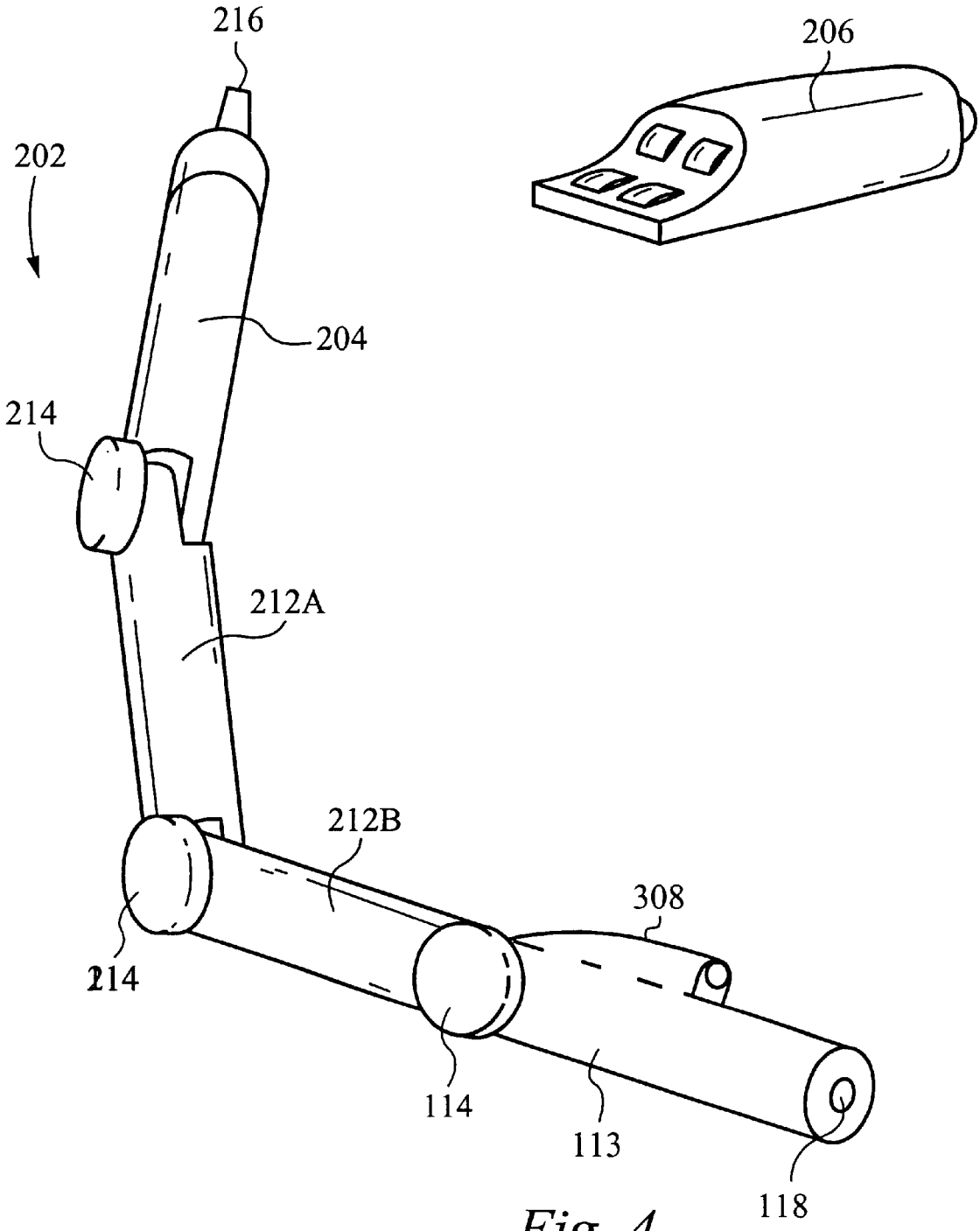
FIG. 4 illustrates a perspective view of the preferred embodiment of the individual components of the motorized light bulb changer in accordance with the present invention.

The wirelessly communicating drive unit 206 and motor unit 204 of the preferred embodiment are illustrated in FIG. 4. The drive unit 206 sends control signals to the infrared signal receiver 308 in the connecting arm 213 to control the operation of the motor unit 204. Preferably, the drive unit 206 is mounted to the bottom of the pole 99 and the motor unit 204 is mounted to the top of the pole 99. The drive unit 206 is also preferably self powered by batteries included within its casing.

The clasping mechanism 202 of the preferred embodiment includes the wirelessly controlled motor unit 204, arm members 212A and 212B, connecting arm 213, knobs 214, adapter 205 and aperture 218. The arm members 212A and 212B, the knobs 214, the adapter 215 and the aperture 218 all preferably operate as described above in relation to FIG. 2.

Figure 5:
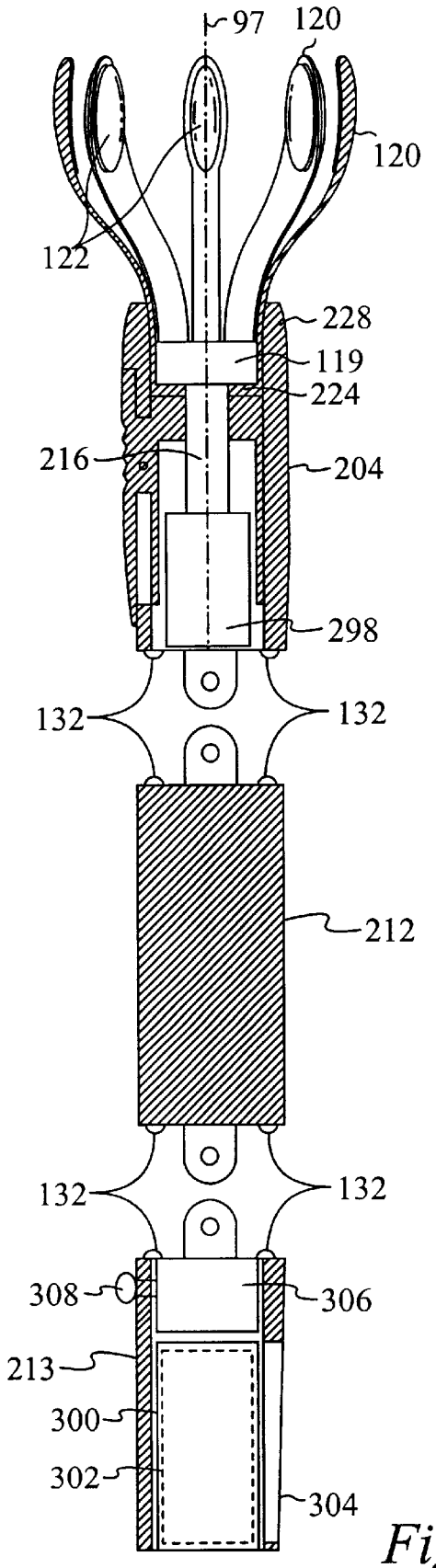
FIG. 5 illustrates a cross sectional view of the preferred embodiment of the clasping mechanism in accordance with the present invention.

A cross sectional view of the preferred embodiment of the motor unit 204 is illustrated in FIG. 5. As shown in FIG. 5, the motor unit 204 is coupled to the arm member 212, whereby the arm member 212 is coupled to the connecting arm 213. The motor unit 204 preferably includes a step motor 298. Alternatively, the motor 298 is any other appropriate type of motor known in the art. The controlling arm 213 includes a control unit 306 within its housing and a battery chamber 300 which is configured to hold one or more batteries 302 for powering the motor 298 and control unit 306. The batteries 302 are changed through a battery door 304. The clasping mechanism 202 includes the adapter 216 which is configured to securely receive and hold the clasping attachment 119. As described above, different sized attachments 119 are used to change different sizes of light bulbs.

The control unit 306 includes an infrared signal receiver 308 which receives control signals from the drive unit 206 for controlling the operation of the motor 298. Based on the control signals received from the drive unit 206, the control unit 306 then controls the operation of the motor 298 to turn in a clockwise or counter-clockwise direction. As shown in FIG. 5, the motor unit 204, the arm member 212 and the controlling arm 213 each preferably include a set of contact points 132 for supplying electrical current between the connecting arm 213 and the motor unit 204, to provide power and control signals to the motor 298. It is also preferred that any number of arm members 212 having contact points 132 may be coupled together between the connecting arm 213 and the motor unit 204. Alternatively, the controlling arm 213 supplies electrical current to the motor unit 204 by a cable (not shown).

Figure 3B:
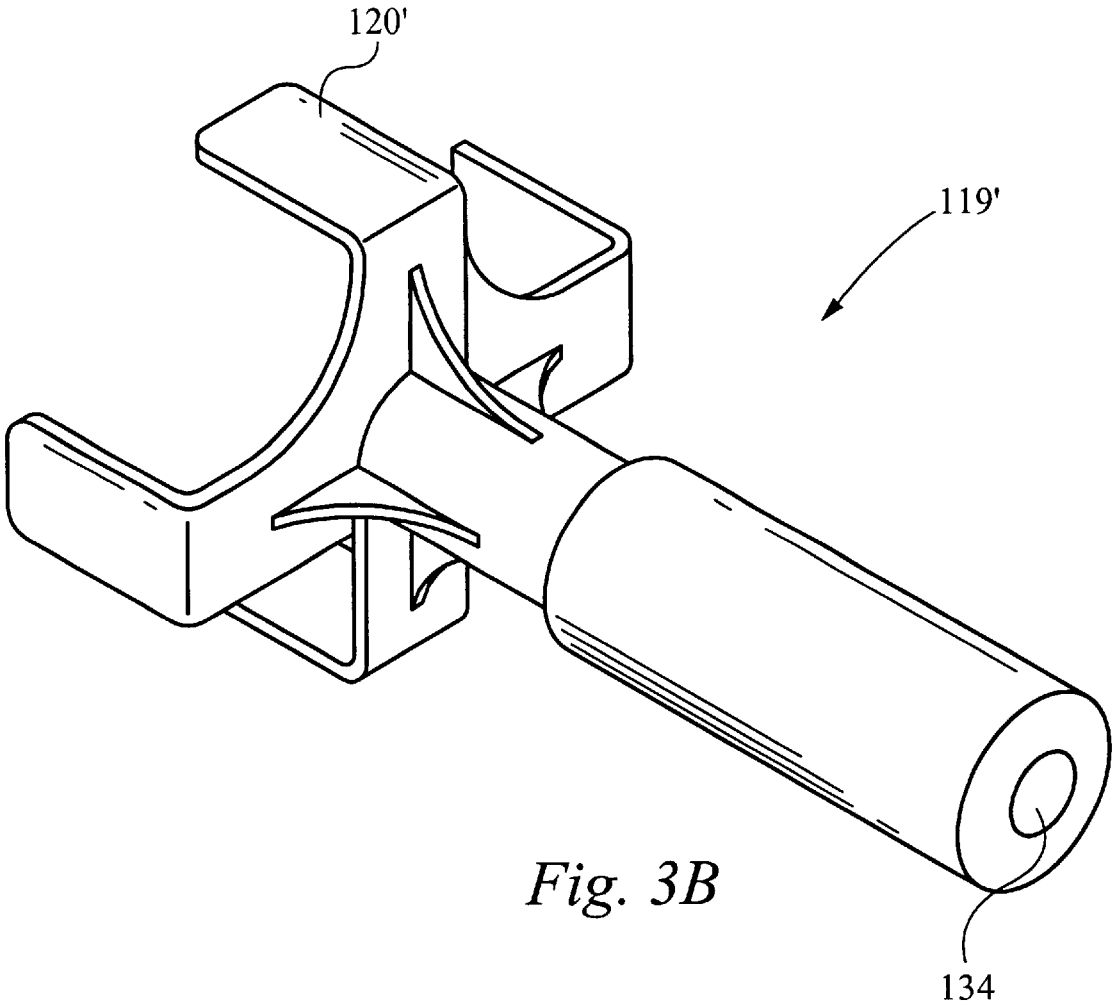
FIG. 3B illustrates a cross sectional view of the preferred embodiment of the fingers in accordance with the present invention.

The clasping attachment, as shown in FIGS. 3A and 3B comprises a set of several fingers 120 for clasping the light bulb 96. Preferably, the clasping attachment 119' includes four fingers 120' which extend and are used in gripping the light bulb 96 as shown in FIG. 3B. In addition, the preferred clasping attachment 119' includes a clasping attachment aperture 134 for engaging the clasping attachment 119' to the adapter 116 (FIG. 3A). Alternatively, the fingers 120 extend in an octagonal pattern with pads 122 on the interior surface of each finger 120 which aid in gripping the light bulb 96, as shown in FIG. 3A. Alternatively, any other number of fingers 120 are used to grip the light bulb 96. Alternatively, each pad 122 is set and attached to the interior of each finger 120 by an adhesive, such as glue. Alternatively, any other appropriate means of attaching the pad 122 to the finger 120 is used. The fingers 120 are alternatively tensioned or spring urged to snugly fit over the light bulb 96 to screw or unscrew the light bulb 96 from its socket. Each finger 120, as shown in FIGS. 3A and 5, has a profile such that a portion of the finger 120 is parallel to the axis 97 near the adapter 116 and gradually extends in an outward direction away from the axis 97 to the area where the pad 122 is attached. Further, each finger 120 is preferably made of an elastic material to allow the fingers 120 to bend toward or away from each other, depending on the size of the light bulb 96.

It is preferred that the clasping mechanism 202 is able to rotate about the axis 97, thereby causing the fingers 120 to rotate in communication with the adapter 216 that is driven by the motor 298. The clasping mechanism 202 is thus able to rotate in a clockwise position or a counter-clockwise position relative to the axis 97. In other words, the clasping mechanism 202 preferably rotates clockwise or counter-clockwise depending on the controls received by the control unit 306 from the drive unit 206. Thus, the motor 298, when activated by the control unit 306, causes the adapter 216 to rotate about the axis 97, thereby causing the fingers 120 to rotate along with the adapter 216. The rotation of the fingers 120 in the clockwise rotation allows the user to screw in the light bulb 96 (FIG. 1A). In contrast, the rotation of the fingers 120 in the counter-clockwise rotation allows the user to unscrew the light bulb 96 (FIG. 1A). It should be noted that the set of fingers 120 rotates clockwise or counter-clockwise independently of the configuration or position of the clasping mechanism 202 and the pole 99.

In the alternative embodiment, as shown in FIG. 3A, the clasping mechanism 102 is also able to move in another direction such that a distance or dimension between oppositely facing fingers 120 varies or adjusts to allow the clasping mechanism 102 to clasp or engage different sized light bulbs 96. As shown in FIG. 3A, each finger 120 in the clasping mechanism 102 has a protruding tab 124 which fits beneath the adapter 116. As stated above, the adapter 116 is positioned inside the motor unit 104 and moves upwards and downwards along the axis 97. In addition, in this embodiment the adapter 116 moves in various positions anywhere along the axis 97 depending on the amount of voltage supplied to the motor 98 by the drive unit 106. A predetermined voltage supplied by the drive unit 106 to the motor 98 will cause the adapter 116 to move upward along the axis 97. In contrast, a different predetermined voltage supplied by the drive unit 106 to the motor 98 will cause the adapter 116 to move downward along the axis 97.

As shown in FIG. 3A, the fingers 120 have an outward extending configuration and are located adjacent to the housing 128 of the motor unit 104. Since the fingers 120 are coupled to the adapter 116, movement of the adapter 116 in the downward direction along the axis 97 causes the outer surface profile of each finger 120 to move toward each other and toward the axis 97, itself. Thus, voltage supplied by the drive unit 106 which causes the adapter 116 to move downward causes the dimension between oppositely facing fingers 120 to decrease. In contrast, since the profile of each finger 116 gradually extends in an outward direction away from the axis 97, the oppositely facing fingers naturally move away from the axis 97 as the adapter moves upward along the axis 97. Thus, voltage supplied by the drive unit 106 which causes the adapter 116 to move upward causes the dimension between oppositely facing fingers 120 to increase. Therefore, the change in position of the adapter 116 within the housing 128 of the motor unit 104 adjusts the dimension or spacing between the fingers 120 to allow the clasping mechanism 102 to clasp different sized light bulbs 96 ranging from flood lights to Christmas bulbs.

The operation in screwing in a light bulb 96 will now be discussed. In operation, as shown in FIG. 1, the user couples the lower arm 112 having the aperture 118 to one end 99A of the pole 99 by a set of clips 130. The user then couples the drive unit 106 to the other end 99B of the pole 99. The user then secures the cable between the motor unit 104 and the drive unit 106 by using an appropriate number of clips, as mentioned above. It should be understood that the drive unit 206 and the motor unit 204 of the preferred embodiment, are coupled to the pole 99 in a similar manner, without the cable 108. Once the motorized light bulb changer 100 is coupled to the pole 99 and is sufficiently secure, the arm members 112 and connecting arm 113 are adjusted to the desired configuration by use of the knobs 114. Once the desired configuration is attained, the user either pushes or pulls the knobs 114 to allow the clasping mechanism 102 to reach the socket which receives the light bulb 96. The user then adjusts the length of the light bulb changer 100, if necessary. The user then positions the fingers 120 around the light bulb 96 and engages the light bulb 96. Preferably this is done by coupling the appropriate sized clasping attachment 119' (FIG. 3B) to the adapter 116. Alternatively, this is done by pressing the corresponding button on the drive unit 106, whereby the drive unit 106 will supply an appropriate voltage to activate the adapter 116. Once the light bulb 96 is engaged within the clasping mechanism 102, the user places the light bulb in the corresponding socket (FIG. 1A) and presses the corresponding button on the drive unit 106 to activate the clasping mechanism 102. The voltage applied by the drive unit 106 causes the motor 98 and the adapter 116 to rotate clockwise. The motion of the adapter 116 causes the fingers 120 to rotate accordingly. Thus, a clockwise rotation of the motor 98 and adapter 116 causes the fingers 120 to rotate clockwise in any orientation of the arms 112. Unscrewing the light bulb 96 is done by the same method, except that the user presses the button on the drive unit 106 to turn the clasping mechanism 102 counterclockwise.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

We claim:

1. A tool for selectively tightening and loosening a light bulb, the tool adapted to be coupled to a tubular member configured along a longitudinal axis, comprising:

a. means for clasping the light bulb, the clasping means configured to have an adjustable dimension for clasping a correspondingly sized light bulb;

b. means for activating the clasping means, the activating means is configured for remote communication with the clasping means, wherein the activating means sends control communications to move the clasping means in a first direction and a second direction; and c. means for positioning the clasping means in a desired configuration, wherein the positioning means is configured to move the clasping mechanism laterally with respect to the longitudinal axis.

2. The tool according to claim 1 further comprising means for setting the clasping means in a desired configuration to engage the light bulb, wherein the setting means is coupled to the clasping means.

3. The tool according to claim 2 wherein the means for setting further comprises a means for varying the adjustable dimension, wherein the varying means is coupled to the activating means.

4. The tool according to claim 1 wherein the control communications are sent wirelessly from the activating means to the clasping means.

5. The tool according to claim 1 wherein the clasping means and the activating means are coupled to one another by a cable.

6. The tool according to claim 5 wherein the clasping means and the activating means are coupled to the tubular member.

7. The tool according to claim 6 further comprising means for securing the cable to the tubular member.

8. The tool according to claim 6 further comprising means for selectively adjusting an overall length of the tubular member.

9. The tool according to claim 1 wherein the means for activating is powered by a DC voltage source.

10. The tool according to claim 1 wherein the means for activating is powered by an AC voltage source.

11. A light bulb changing tool comprising:

a. a motorized clasping mechanism configured to engage a light bulb, the motorized clasping mechanism configured along an axis and to actuate in a first direction and a second direction;

b. an electronic drive unit configured for remote communication with the motorized clasping mechanism, wherein the electronic drive unit sends control communications to drive the motorized clasping mechanism to selectively move in the first direction and the second direction; and c. an arm member for positioning the motorized clasping mechanism in a desired configuration to engage the light bulb, the arm member coupled to the motorized clasping mechanism and adapted to be coupled to a tubular member, wherein at least a portion of the arm member is laterally moveable with respect to the tubular member.

12. The tool according to claim 11 wherein the motorized clasping mechanism further comprises a rotator mechanism configured to rotate the motorized clasping mechanism in the first direction about the axis.

13. The tool according to claim 11 wherein the motorized clasping mechanism further comprises a plurality of spring urged fingers.

14. The tool according to claim 13 further comprising an adjusting mechanism configured to actuate the motorized clasping mechanism in the second direction, wherein the adjusting mechanism causes at least two of the plurality of spring urged fingers to actuate towards and away from the axis.

15. The tool according to claim 11 wherein the control communications are sent wirelessly from the electronic drive unit to the motorized clasping mechanism.

16. The tool according to claim 11 wherein the motorized clasping mechanism and the electronic drive unit are coupled to one another by a cable.

17. The tool according to claim 11 wherein the electronic drive unit is coupled to the tubular member.

18. The tool according to claim 17 further comprising a clip for securing the wire to the tubular member.

19. The tool according to claim 11 wherein the electronic drive unit is powered by a DC voltage source.

20. The tool according to claim 11 wherein the electronic drive unit is powered by an AC voltage source.

21. A method of assembling a light bulb changing tool, the method comprising the steps of:

a. providing a clasping mechanism configured to engage a light bulb, the clasping mechanism having an adjustable dimension, b. coupling an adjusting arm to the clasping mechanism, the adjusting arm configured to selectively move the clasping mechanism laterally relative to a longitudinal axis;

c. coupling the adjusting arm to a cylindrical member configured along the longitudinal axis; and d. coupling a drive unit to the cylindrical member, the drive unit in remote communication with the clasping mechanism, wherein the drive unit sends control communications to electrically activate the clasping mechanism to actuate in a first direction and a second direction.

22. The method according to claim 21 wherein the control communications are sent wirelessly from the drive unit to the clasping mechanism.

23. The method according to claim 22 further comprising the step of coupling the clasping mechanism and the drive unit to one another by a cable.

24. The method according to claim 23 further comprising securing the cable to the cylindrical member with a clip.

25. A light bulb changing tool assembly adapted to be coupled to a cylindrical member comprising:

a. a motorized clasping mechanism for engaging a light bulb, the motorized clasping mechanism rotatable in a first direction and a second direction, the motorized clasping mechanism having a port for engaging to the cylindrical member; and b. an electronic drive unit for remotely communicating with the motorized clasping mechanism to selectively move the motorized clasping mechanism in the first direction and the second direction, the electronic device configured to externally attach to the cylindrical member.

26. A motorized clasping mechanism for changing a light bulb comprising:

a. a clasping mechanism housing including:

i. a plurality of fingers configured along an axis;

ii. a motor coupled to the plurality of fingers and configured to selectively actuate the fingers in a desired direction about the axis in response to an appropriate communication signal from a remotely located control source; and b. an arm member coupled to the clasping mechanism housing and adapted to couple to a tubular member and configured to position the clasping mechanism in a desired configuration, wherein at least a portion of the arm member is independently moveable with respect to another portion of the arm member.

* * * * *